US009552687B2

(12) United States Patent
Melnick et al.

(10) Patent No.: US 9,552,687 B2
(45) Date of Patent: Jan. 24, 2017

(54) THREE-DIMENSIONAL REELS FOR AN ELECTRONIC GAMING DEVICE

(71) Applicant: Cadillac Jack, Inc., Duluth, GA (US)

(72) Inventors: Scott Andrew Melnick, Atlanta, GA (US); Carmen DiMichele, Norcross, GA (US); Donald James Rollo, III, Dacula, GA (US); Enock Etienne, Lilburn, GA (US)

(73) Assignee: Cadillac Jack, Inc., Duluth, GA (US)

( * ) Notice: Subject to any disclaimer, the term of this patent is extended or adjusted under 35 U.S.C. 154(b) by 7 days.

(21) Appl. No.: 13/776,938

(22) Filed: Feb. 26, 2013

(65) Prior Publication Data

US 2013/0310140 A1 Nov. 21, 2013

Related U.S. Application Data

(63) Continuation of application No. 13/474,715, filed on May 18, 2012.

(51) Int. Cl.
*G07F 17/32* (2006.01)

(52) U.S. Cl.
CPC ..... *G07F 17/3213* (2013.01); *G07F 17/3211* (2013.01)

(58) Field of Classification Search
CPC ... G07F 17/3211; G07F 17/3202; G07F 17/32
USPC ..... 463/20
See application file for complete search history.

(56) References Cited

U.S. PATENT DOCUMENTS

| | | | | |
|---|---|---|---|---|
| 6,183,088 | B1 * | 2/2001 | LoRe et al. | 353/7 |
| 6,908,381 | B2 * | 6/2005 | Ellis | G07F 17/34 463/13 |
| 7,841,944 | B2 * | 11/2010 | Wells | 463/37 |
| 8,414,380 | B2 * | 4/2013 | Saunders et al. | 463/20 |
| 2004/0043812 | A1 * | 3/2004 | Ellis | G07F 17/34 463/20 |
| 2006/0139448 | A1 * | 6/2006 | Ha | H04N 13/0404 348/51 |
| 2008/0113775 | A1 * | 5/2008 | Williams | G07F 17/3202 463/25 |
| 2009/0264179 | A1 * | 10/2009 | McKay et al. | 463/20 |
| 2011/0045906 | A1 * | 2/2011 | Berman | G07F 17/34 463/32 |
| 2011/0244942 | A1 * | 10/2011 | Aoki | G07F 17/34 463/20 |

* cited by examiner

*Primary Examiner* — Omkar Deodhar
*Assistant Examiner* — Shauna-Kay Hall
(74) *Attorney, Agent, or Firm* — Weide & Miller, Ltd.

(57) ABSTRACT

Examples disclosed herein relate to systems and methods for delivering game play, which may include providing wagering game options that may include a two-dimensional option, a three-dimensional option, and/or a combination of both.

17 Claims, 19 Drawing Sheets

502

| B | I | N | G | O |
|---|---|---|---|---|
| 7 | 23 | 31 | 51 | 69 |
| 13 | 17 | 37 | 47 | 70 |
| 2 | 29 | FREE | 56 | 71 |
| 1 | 16 | 43 | 53 | 73 |
| 11 | 25 | 36 | 49 | 65 |

504A

| B | I | N | G | O |
|---|---|---|---|---|
| 8 | 26 | 40 | 46 | 73 |
| 14 | 29 | 31 | 55 | 68 |
| 15 | 28 | FREE | 48 | 70 |
| 2 | 21 | 36 | 54 | 61 |
| 4 | 19 | 33 | 44 | 72 |

504B

| B | I | N | G | O |
|---|---|---|---|---|
| 10 | 18 | 42 | 49 | 75 |
| 3 | 22 | 35 | 45 | 70 |
| 9 | 21 | FREE | 51 | 64 |
| 5 | 30 | 40 | 56 | 63 |
| 13 | 23 | 44 | 53 | 61 |

504C

502

THREE-DIMENSIONAL REELS FOR AN ELECTRONIC GAMING DEVICE

CROSS-REFERENCE TO RELATED PATENT APPLICATION

This application is a continuation of prior application Ser. No. 13/474,715 entitled "THREE-DIMENSIONAL REELS FOR AN ELECTRONIC GAMING DEVICE", filed on May 18, 2012, which is incorporated herein by reference in its entirety.

FIELD

The subject matter disclosed herein relates to an electronic gaming device. More specifically, the disclosure relates to an electronic gaming device, which provides wagering game options include a two-dimensional option, a three-dimensional option, and/or a combination of both.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Reels of an electronic gaming device (e.g., a slot machine) are utilized to display various symbols, which are utilized to determine whether a specific spin/activation of a game has resulted in a winning combination of these symbols. A new way of delivering this game play includes providing wagering game options, which may include a two-dimensional option, a three-dimensional option, and/or a combination of both.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
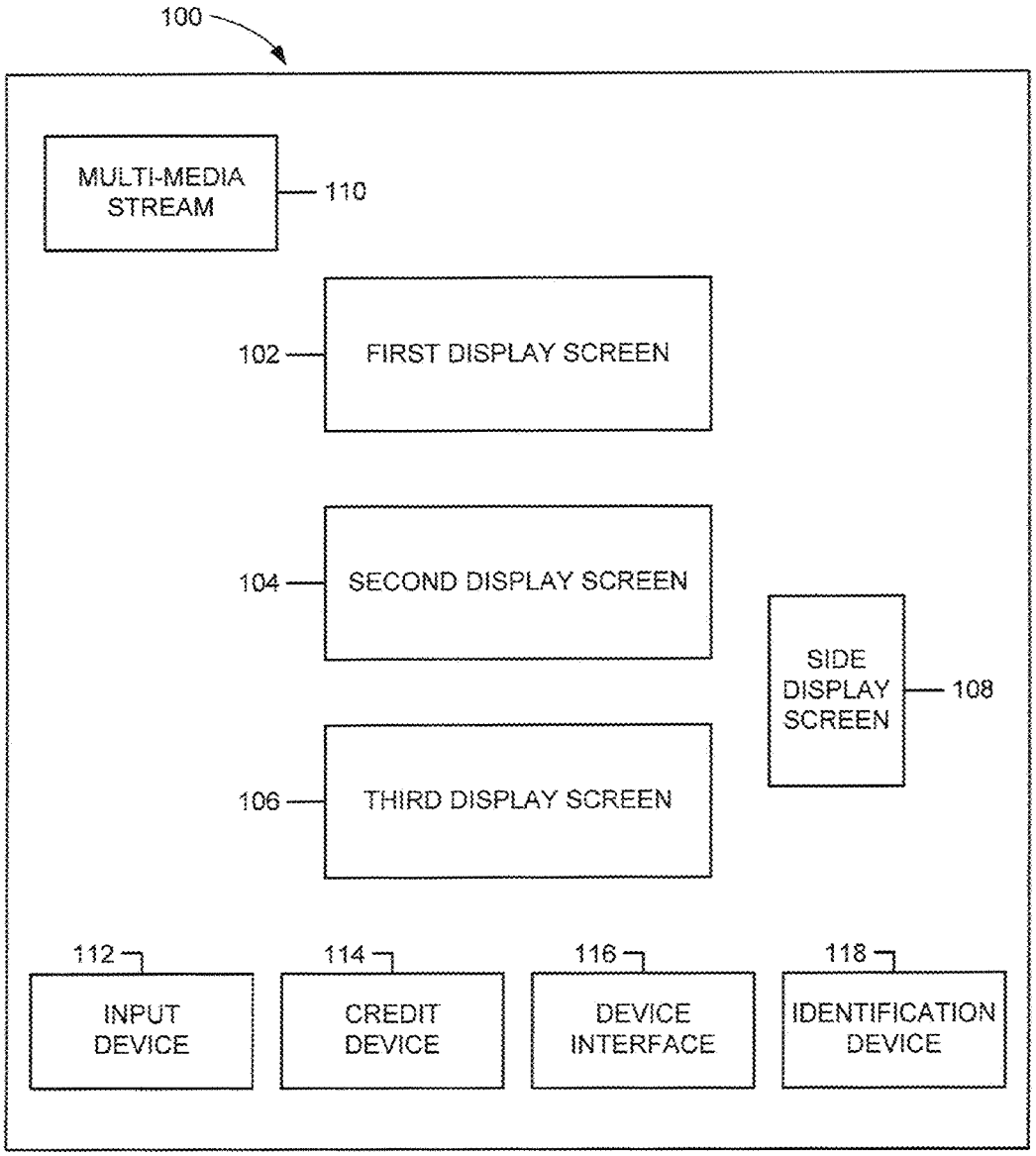
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an internet event, and/or any combination thereof. In another example, the wagering event may be a poker tournament, a horse race, a car race, and/or any combination thereof. The advertisement may be an advertisement for the casino, a restaurant, a shop, any other entity, and/or any combination thereof. The sporting event may be a football game, a baseball game, a hockey game, a basketball game, any other sporting event, and/or any combination thereof. All of these multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, or any combination thereof.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, or any combination thereof.

Device interface 116 may be utilized to connect a player to electronic gaming device 100 through a mobile device, card, keypad, identification device 118, or any combination thereof. Device interface 116 may include a docking station by which a mobile device is plugged into electronic gaming machine 100. Device interface 116 may include an over the air connection by which a mobile device is connected to electronic gaming machine 100 (e.g. Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, a two-dimensional gaming option may be presented, a three-dimensional gaming option may be presented, and the placement of gaming options may be modified based on player preference data. For example, a player may want to have 3D gaming options only. Therefore, no 2D games would be presented. In another example, the player may only want 2D options. Therefore, no 3D gaming options would be presented.

Identification device 118 may utilize biometrics (e.g. thumb print, retinal scan, or other biometric). Identification device 118 may include a card entry slot for input device 112. Identification device 118 may include a keypad with an assigned pin number for verification. Identification device 118 may include multiple layers of identification for added security. For example, a player could be required to enter a player tracking card, and/or a pin number, and/or a thumb print, or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; the electronic gaming device 100 will then automatically display the current baseball game onto side display screen 108 and/or alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, or any combination thereof. Second display screen 104, third display screen 106, side display screen 108, and any other screen may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multimedia 110, and the media may be displayed on first display screen 102.

Figure 2:
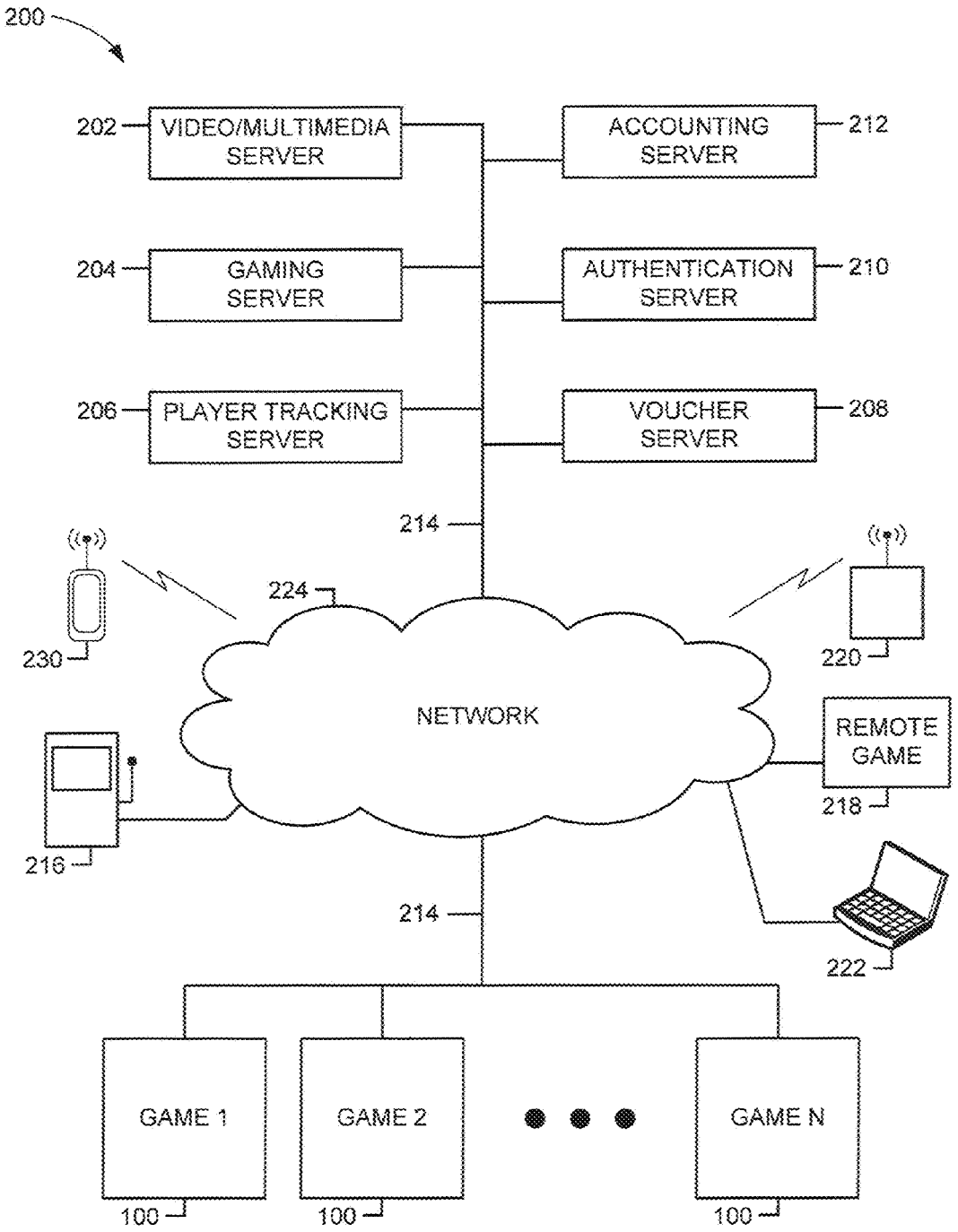
FIG. 2 is an illustration of the electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the internet, a private network, or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 218. Video server 202 may transmit these video streams via network link 214 and/or network 224.

For example, a remote gaming device at the same location may be a casino with multiple casino floors, a casino which allows wagering activities to take place from the room, a casino which may allow wagering activities to take place from the pool area, etc. In another example, the remote devices may be at another location, such a progressive link to another casino, or a casino corporation, which owns many different casinos (e.g. MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes.

Player tracking server 206 may track a player's betting activity, a player's preferences (e.g., language, font, sound level, drinks, etc.). Based on data obtained by player tracking server 206, a player may be eligible for gaming rewards (e.g. free play), promotions, and/or other awards (e.g., complimentary food, drinks, lodging, concerts, etc.).

Voucher server 208 may generate a voucher, which may include data relating to gaming. Further, the voucher may include payline structure option selections.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for player's tracked outcomes.

Network connection 214 may be used for communication between dedicated servers, thin clients, thick clients, back-office accounting systems, etc.

Laptop computer 222 and/or any other electronic device (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (such as cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components such as network interface cards, repeaters and hubs, bridges, switches, routers, and firewalls, or any combination thereof may also be part of network 224.

Figure 3:
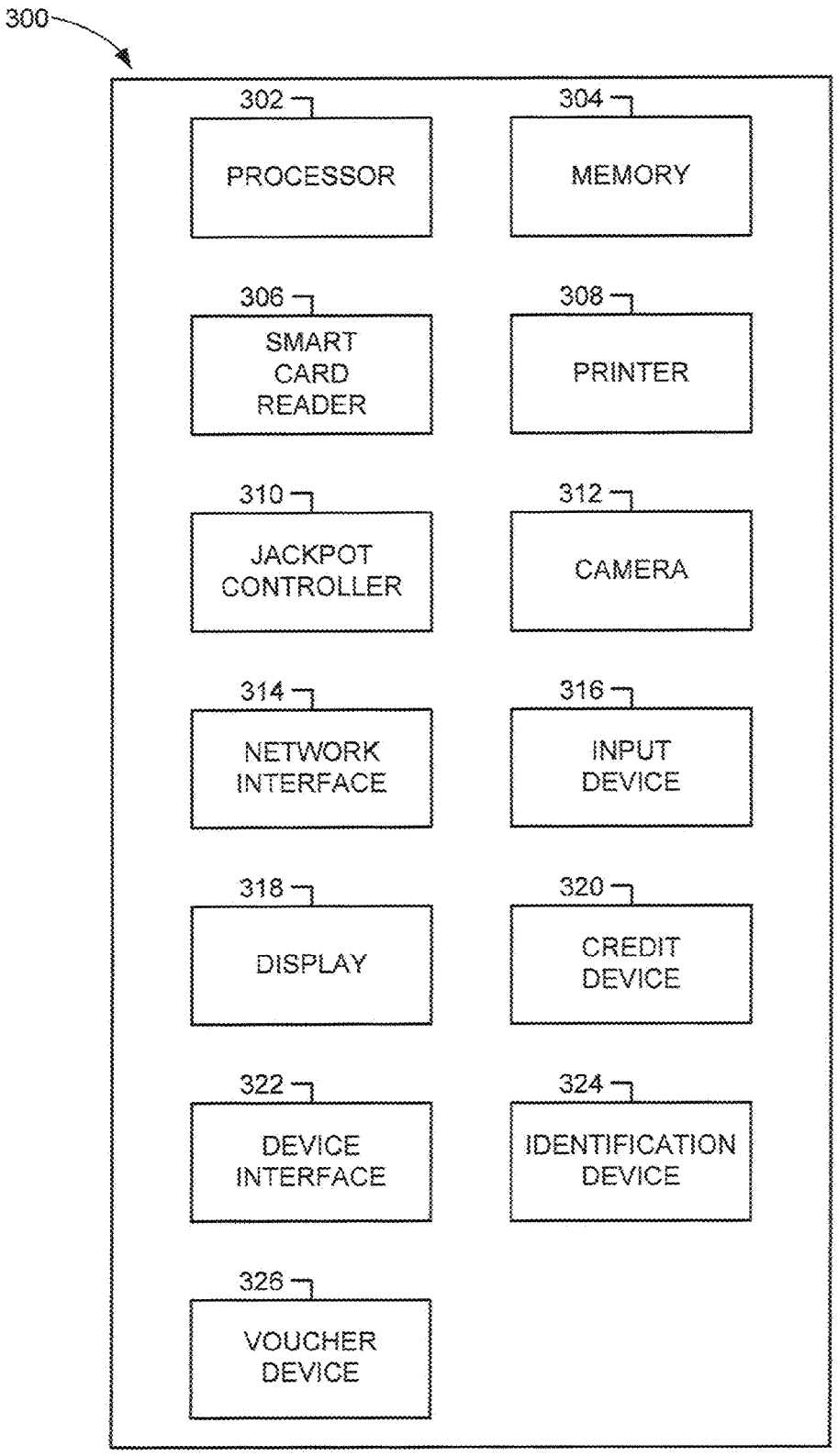
FIG. 3 is an illustration of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display content onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308 and/or video or pictures captured by camera 312 may be saved and stored on memory 304. Memory 304 may include a confirmation module, which may authenticate a value of a voucher and/or the validity of the voucher. The processor may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory such as read-only memory ("ROM"), erasable programmable read-only memory ("EPROM"), electrically erasable programmable read-only memory ("EEPROM"), flash memory ("NVRAM"), or Nano-RAM (carbon nanotube random access memory), and/or any combination thereof.

Memory 304 may also be volatile semiconductor memory such as dynamic random access memory ("DRAM") or static random access memory ("SRAM"), and/or any combination thereof.

Memory 304 may also be a data storage device such as a hard disk drive, an optical disk drive such as CD, DVD, or Blu-ray, a solid state drive, a memory stick, a CompactFlash card, a USB flash drive, a Multimedia Card, an xD-Picture Card, or any combination thereof.

Memory 304 may be used to store read-only program instructions for execution by processor 302, for the read-write storage for global variables and static variables, read-write storage for uninitialized data, read-write storage for dynamically allocated memory, and for the read-write storage of the data structure known as "the stack", or any combination thereof.

Memory 304 may be used to store the read-only pay table information for which symbol combinations on a given payline that result in a win (payout) are established for games of chance such as slot games and video poker.

Memory 304 may be used to store accounting information (such as cashable electronic promotion in, non-cashable electronic promotion out, coin in, coin out, bill in, voucher in, voucher out, electronic funds transfer in, etc.).

Memory 304 may be used to record error conditions on an electronic gaming device 100 such as door open; coin jam; ticket print failure; ticket (paper) jam; program error; reel tilt; etc. or any combination thereof.

Memory 304 may also be used to record the complete history for the most recent game played plus some number of prior games as determined by the regulating authority.

Smart card reader 306 may allow electronic gaming device 100 to access and read information provided by the player or technician, which may be used for setting of player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupon (i.e., a wagering instrument with a fixed waging value that can only be used for non-cashable credits), drink tokens, comps, or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include their image into the game play. A picture of a player may be an actual image as taken by camera 312. A picture of a player may be a computerized caricature of image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Video obtained by camera 312 may then be used as part of game play, or may be used for security purposes. For example, a camera located on electronic gaming device 100 may capture video of a potential illegal activity (e.g. tampering with the machine, crime in the vicinity, underage players, etc.).

Network interface 314 may allow electronic gaming device 100 to communicate with video server 202, gaming server 204, player tracking server 206, voucher server 208, authentication server 210, and/or accounting server 212.

Input device 316 may be mechanical buttons, electronic buttons, a touch screen, or any combination thereof. Input device 316 may be utilized to make a wager, to make an offer to buy or sell a voucher, to determine a voucher's worth, to cash in a voucher, to modify electronic gaming device 100 (e.g., change sound level, configuration, font, language, etc.), to select a movie or music, to select live video streams (e.g. sporting event 1, sporting event 2, sporting event 3), to request services (e.g., drinks, manager, etc.), or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor to allow for game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with their mobile device (e.g. smart phone) to receive information from and/or transmit information to electronic gaming device 100 (e.g., watch a movie, listen to music, obtain verbal betting options, verification of identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or alternate display screen as set in the player's options.

A voucher device 326 may generate, print, transmit, or receive a voucher. The voucher may represent a wagering option, a wagering structure, a wagering timeline, a value of wager, a payout potential, a payout, or any other wagering data. A voucher may represent an award, which may be used for other locations inside of the gaming establishment. For example, the voucher may be a coupon for the local buffet or a concert ticket.

Figure 4:
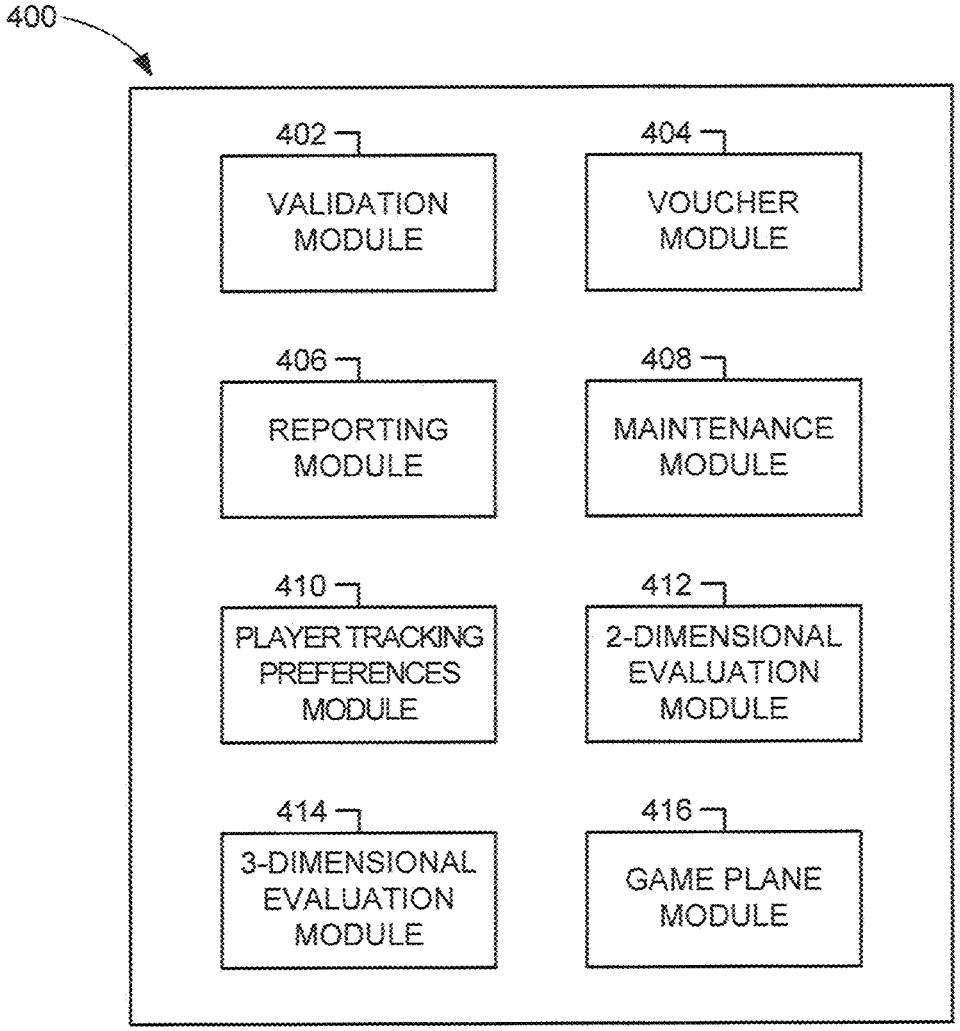
FIG. 4 is a block diagram of the software modules of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, a 2D evaluation module 412, a 3D evaluation module 414, and a game plane module 416.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

2D evaluation module 412 may be utilized to evaluate the symbol combinations to determine a 2D payout.

3D evaluation module 414 may be utilized to evaluate the symbol combinations to determine a 3D payout. 2D evaluation module 412 may be utilized in combination with 3D evaluation module 414. Further, 2D evaluation module 412 and 3D evaluation module 414 may be combined into a single module.

Game plane module 416 may be utilized to determine which reels are active and/or inactive, which paylines are active and/or inactive, which XYZ planes are active and/or inactive, which symbol sets are active and/or inactive, and/or any combination thereof.

Figures 5A, 5B:
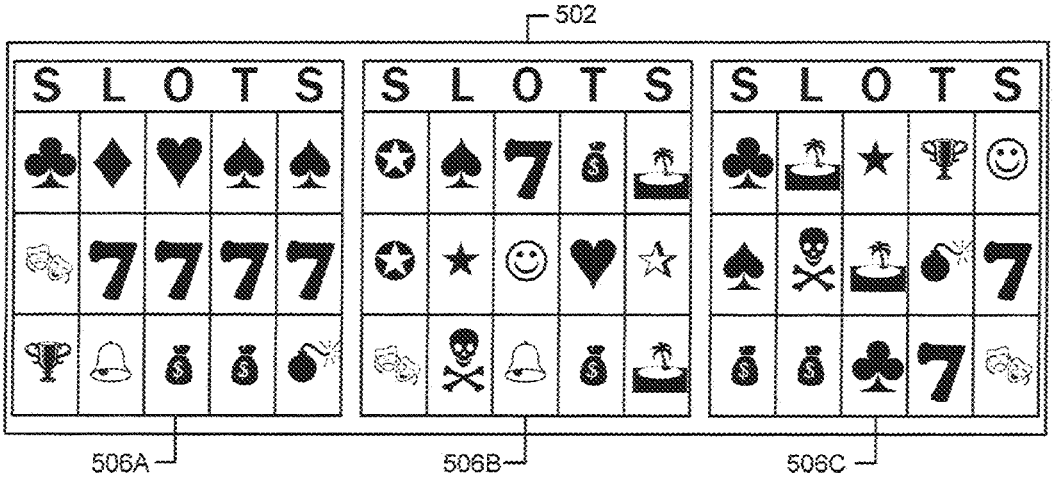
FIG. 5A shows a plurality of bingo cards horizontally arranged in two-dimensional space on a display screen, according to one embodiment.
FIG. 5B shows a plurality of slot games horizontally arranged in two-dimensional space on a display screen, according to one embodiment.

FIG. 5A is an illustration of three bingo games 504A, 504B, and 504C displayed on display screen 502. Both display screen 502 and bingo games 504A, 504B, and 504C may be horizontally arranged and bingo games 504A, 504B, and 504C may span two dimensions (height and width).

FIG. 5B is an illustration of three slot games 506A, 506B, and 506C displayed on display screen 502. Both display screen 502 and slot games 506A, 506B, and 506C may be horizontally arranged, and slot games 506A, 506B, and 506C may span two dimensions (height and width).

Figure 6A:
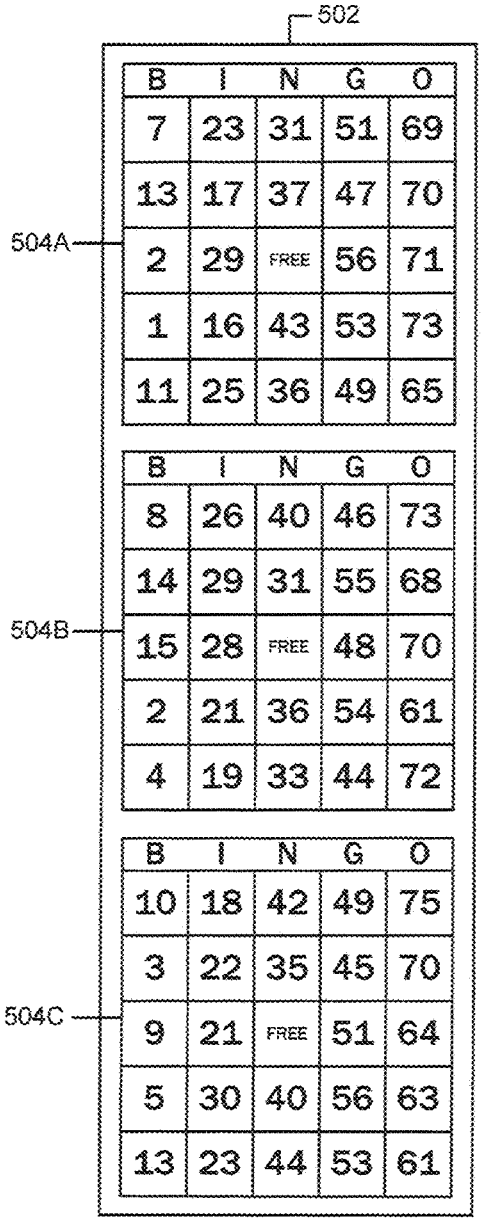
FIG. 6A shows a plurality of bingo cards vertically arranged in two-dimensional space on a display screen, according to one embodiment.

FIG. 6A is an illustration of three bingo games 504A, 504B, and 504C displayed on display screen 502. Both display screen 502 and bingo games 504A, 504B, and 504C may be vertically arranged and bingo games 504A, 504B, and 504C may span two dimensions (height and width).

Figure 6B:
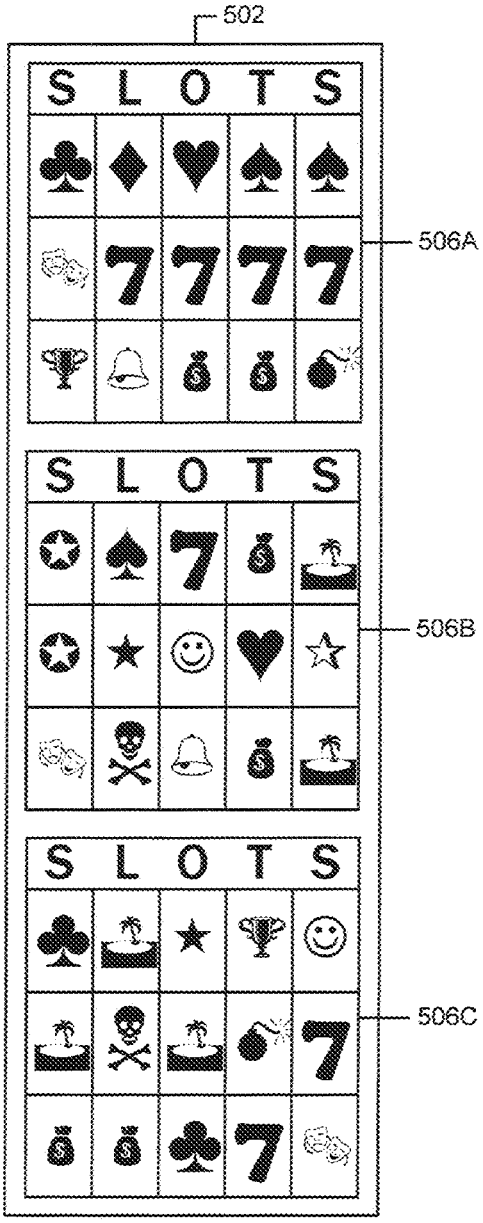
FIG. 6B shows a plurality of slot games vertically arranged in two-dimensional space on a display screen, according to one embodiment.

FIG. 6B is an illustration of three slot games 506A, 506B, and 506C displayed on display screen 502. Both display screen 502 and slot games 506A, 506B, and 506C may be vertically arranged and slot games 506A, 506B, and 506C may span two dimensions (height and width).

Figure 7:
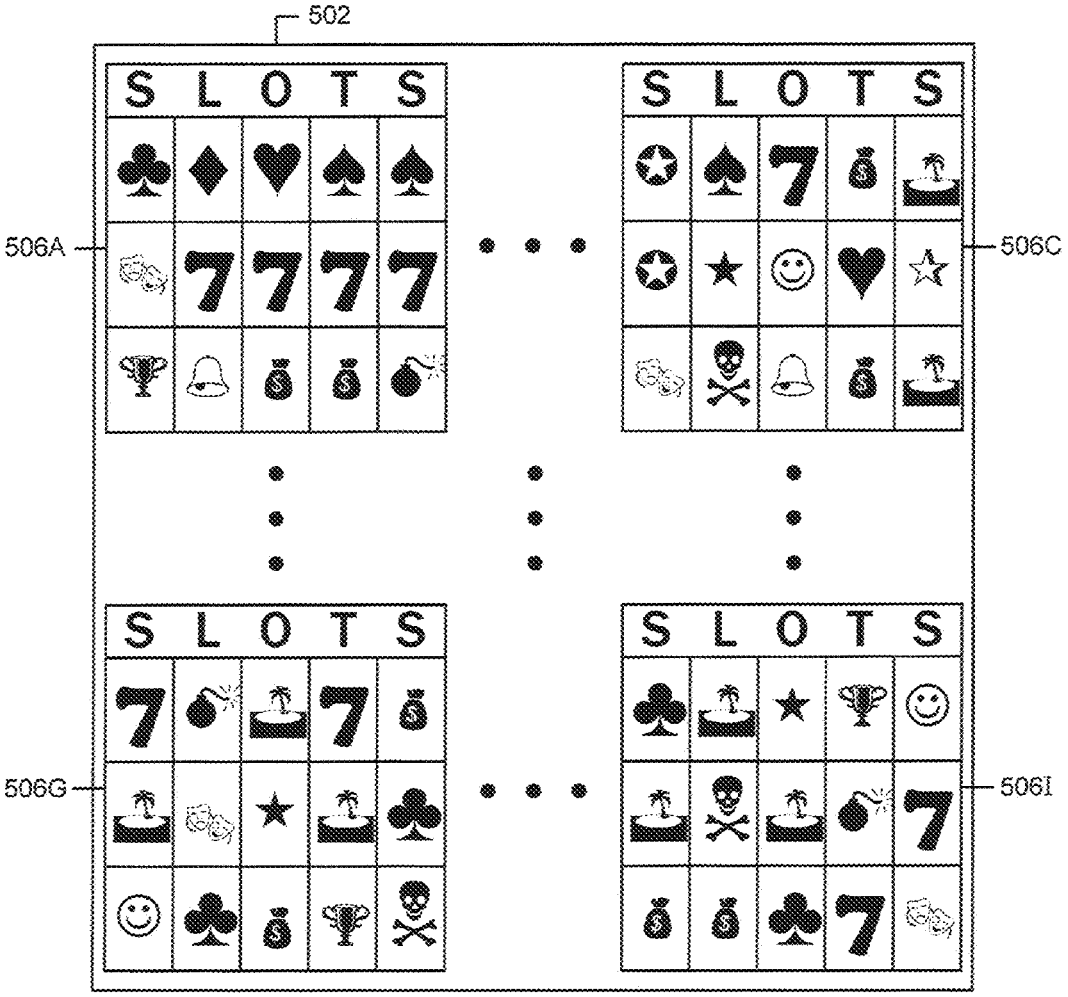
FIG. 7 shows a plurality of slot games both horizontally and vertically arranged in two-dimensional space on a display screen, according to one embodiment.

FIG. 7 is an illustration of a plurality of slot games 506A, 506C, 506G, and 5061 displayed on display screen 502. Display screen 502 may have either horizontal orientation ("landscape") or vertical orientation ("portrait"). The plurality of slot games 506A, 506C, 506G, and 5061 may be simultaneously arranged in both horizontal and vertical directions forming a matrix of rows and columns. In FIG. 7, the groups of three heavy dots are used to infer the presence of additional slot games. There may be any number (e.g., 1 to N) of horizontally oriented reels (or portion thereof), vertically oriented reels (or portion thereof), and/or any combination thereof. This matrix arrangement of rows and columns may span two dimensions (height and width), three dimensions (height, width, length), and/or any combination thereof. Further, any portion of the rows and columns may be utilized.

Figure 8:
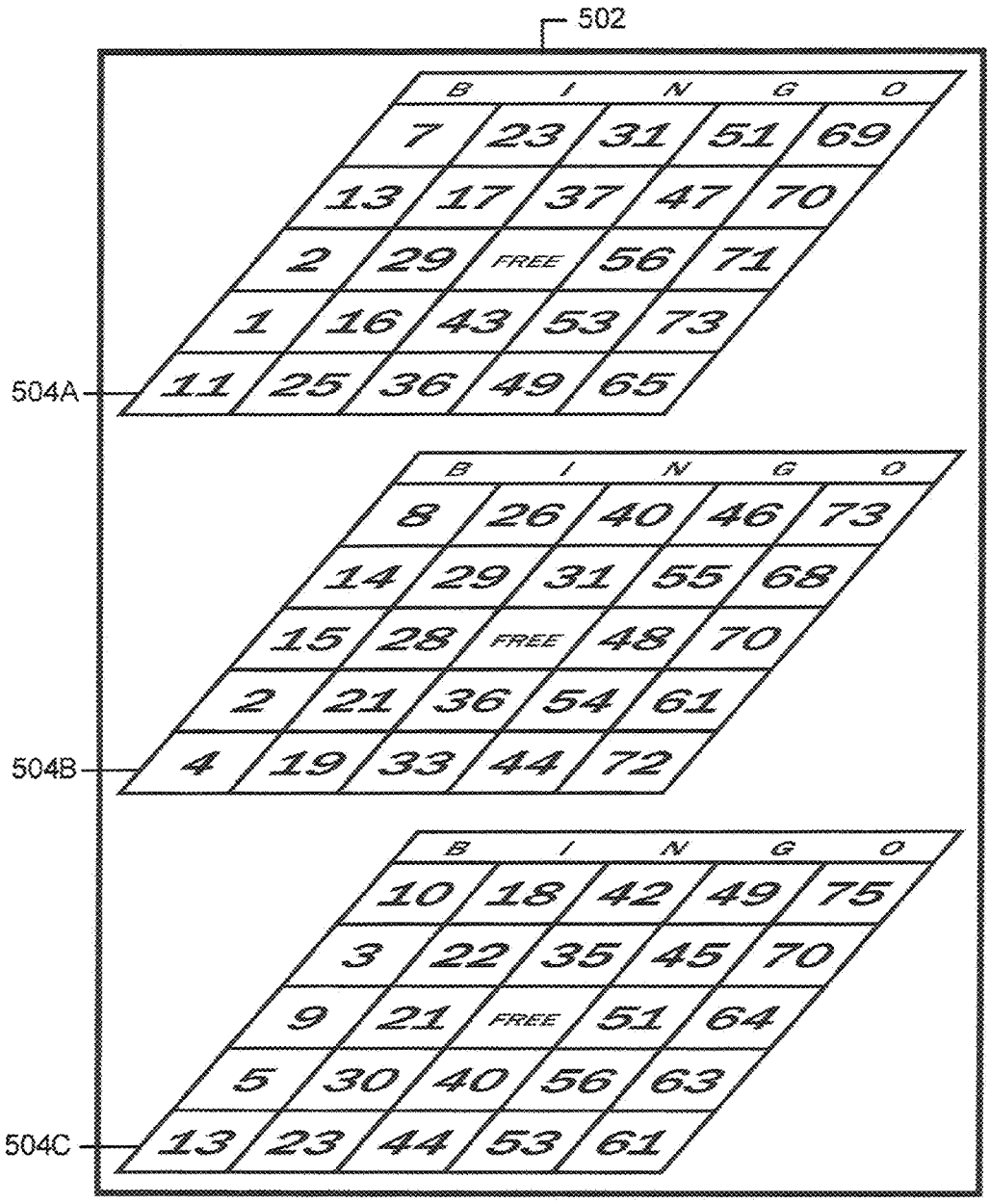
FIG. 8 shows a plurality of bingo cards vertically arranged and horizontally skewed to create a three-dimensional stacking affect, according to one embodiment.

FIG. 8 is an illustration of bingo games 504A, 504B, and 504C displayed on display screen 502. Bingo games 504A, 504B, and 504C may be vertically arranged and horizontally skewed to create a three-dimensional stacking affect, according to one embodiment. In another embodiment, the system and/or method may use linear perspective to create a three-dimensional effect of having bingo games 504A, 5048, and 504C emerge from display screen 502. In an embodiment, the system and/or method may apply a tapering thickness to bingo games 504A, 504B, and 504C to enhance the three-dimensional appearances. In another embodiment, the player may use a joystick, mechanical buttons, mechanical switches, electronic buttons, electronic switches, a keypad, a touch screen, a gesture screen, a pointing device (e.g., a mouse), a virtual keypad, or any combination thereof, to alter the underlying pitch, yaw, and roll that when combined form the three-dimensional appearance of bingo games 504A, 504B, and 504C on display screen 502.

Figure 9A:
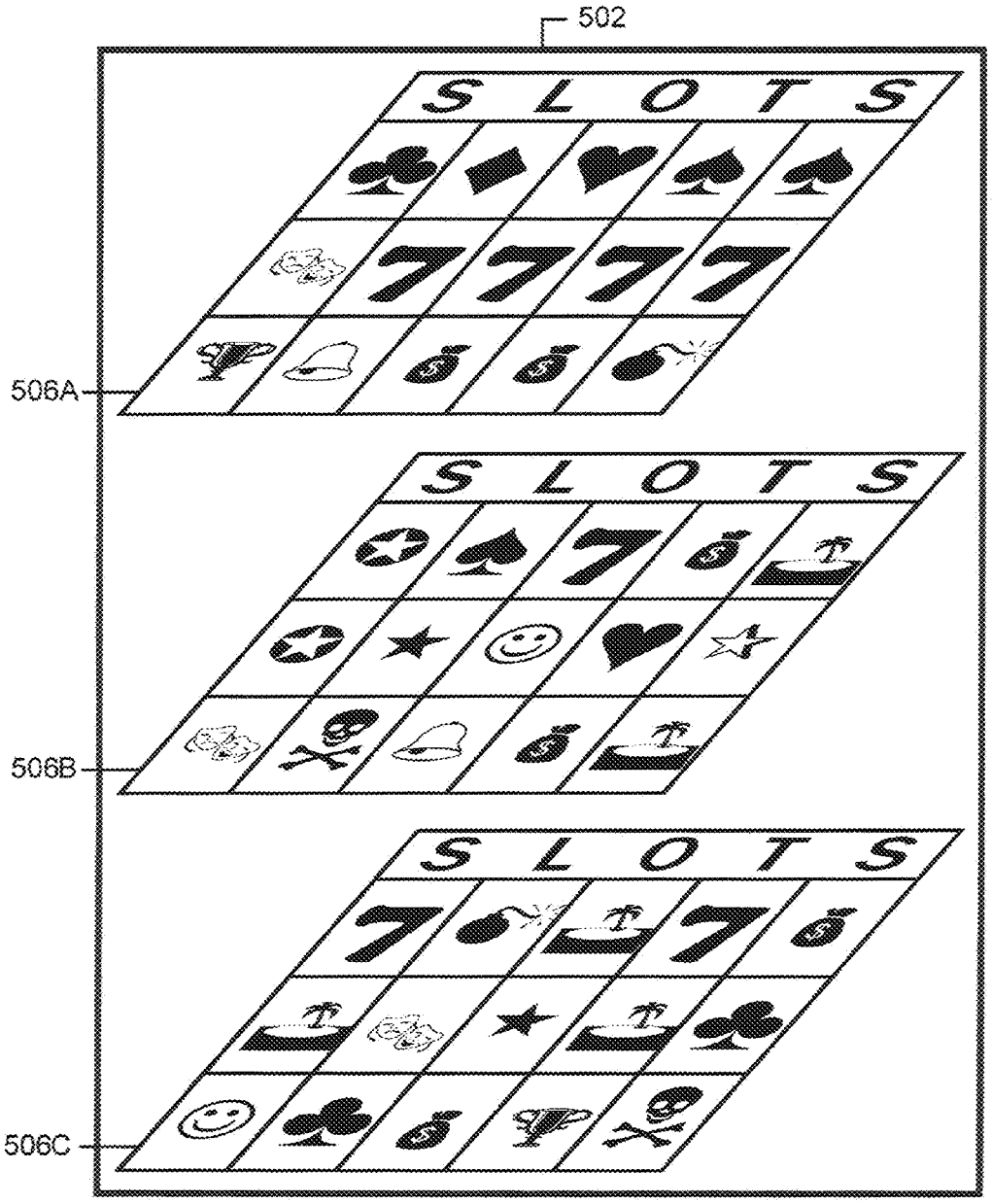
FIG. 9A shows a plurality of slot games vertically arranged and horizontally skewed to create a three-dimensional stacking affect, according to one embodiment.

FIG. 9A is an illustration of slot games 506A, 506B, and 506C displayed on display screen 502, according to one embodiment. Slot games 506A, 506B, and 506C may be vertically arranged and horizontally skewed to create a three-dimensional stacking affect, according to one embodiment. In another embodiment, the system and/or method may use linear perspective to create a three-dimensional effect of having slot games 506A, 506B, and 506C visually emerge from display screen 502. In another embodiment, the system and/or method may apply a tapering thickness to slot games 506A, 506B, and 506C to enhance the three-dimensional appearances. In another embodiment, the player may use a joystick, mechanical buttons, mechanical switches, electronic buttons, electronic switches, a keypad, a touch screen, a gesture screen, a pointing device (e.g., a mouse), a virtual keypad, or any combination thereof, to alter the underlying pitch, yaw, and roll that when combined form the virtual three-dimensional appearance of slot games 506A, 506B, and 506C on display screen 502.

Figure 9B:
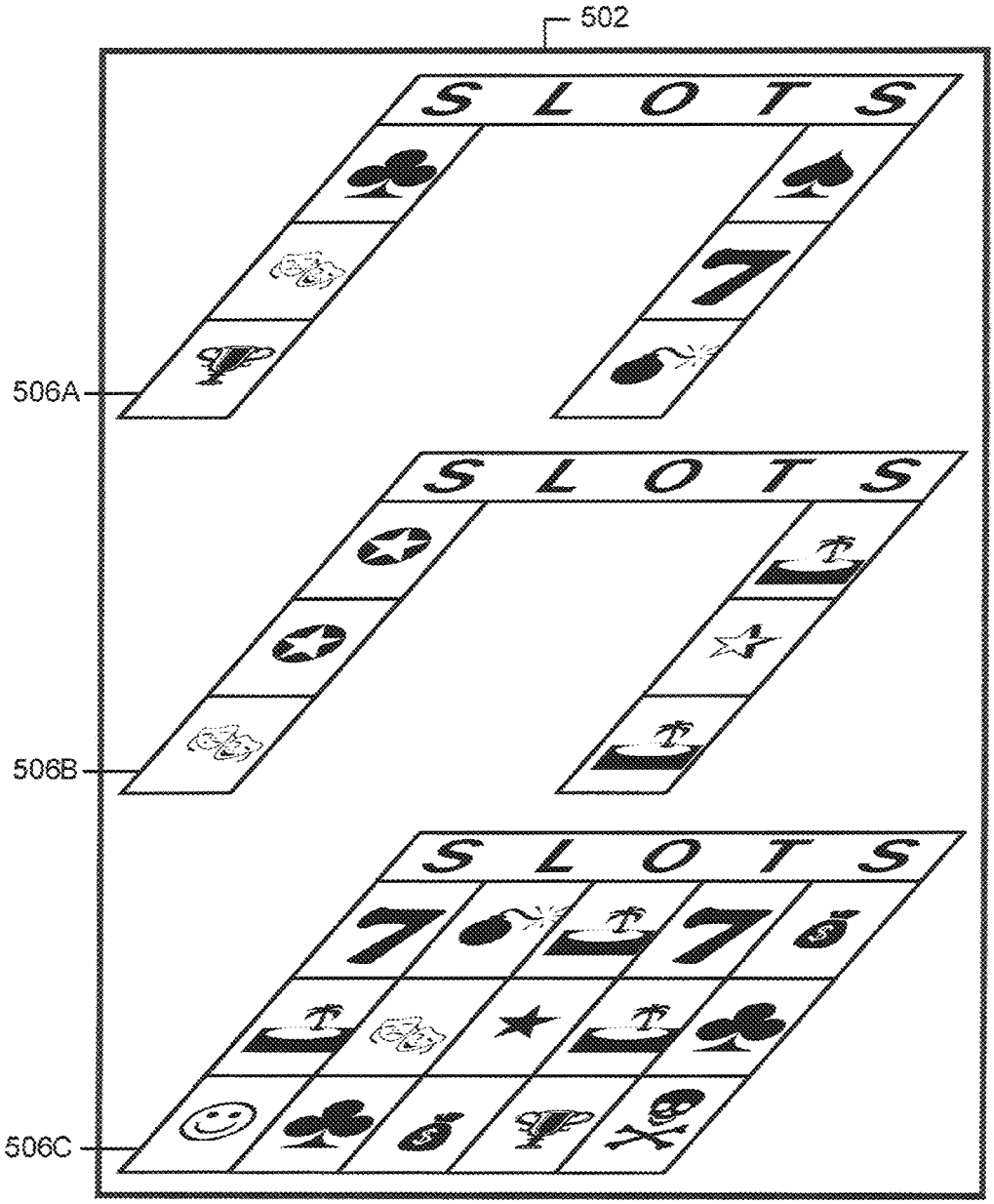
FIG. 9B shows a plurality of slot games (one being a complete slot game and two being partial slot games) vertically arranged and horizontally skewed to create a three-dimensional stacking affect, according to one embodiment.

FIG. 9B shows a plurality of slot games 506A, 506B, and 506C displayed on display screen 502. Slot games 506A and 506B are partial slot games because slot games 506A and 506B each include only two of five possible reels. Slot game 506C is a complete slot game because slot game 506C includes all five possible reels. Slot games 506A, 506B, and 506C may be vertically arranged and horizontally skewed to create a three-dimensional stacking affect, according to one embodiment. In another embodiment, the system and/or method may use linear perspective to create a three-dimensional effect of having the slot games 506A, 506B, and 506C visually emerge from display screen 502. In another embodiment, the system and/or method may apply a tapering thickness to slot games 506A, 506B, and 506C to enhance the three-dimensional appearances. In another embodiment, the player may use a joystick, mechanical buttons, mechanical switches, electronic buttons, electronic switches, a keypad, a touch screen, a gesture screen, a pointing device (e.g., a mouse), a virtual keypad, or any combination thereof, to alter the underlying pitch, yaw, and roll that when combined form the three-dimensional appearance of the slot games 506A, 506B, and 506C on display screen 502. In another embodiment, the player may use these input devices, or any combination thereof, to select the player's desired number of reels on an individual slot game basis. In another example, the player may select the options to allow electronic gaming device 100 to select a desired number of reels automatically. In this example, the player may select an option that requires four 3D reels to activate. Electronic gaming device 100 would select four 3D reels to activate. The activation may be predetermined, random, based on a player's preferences, or based on any other criteria for activation. In another example, the player may select maximum bet (or other criteria), which activates all of the reels and/or paylines. In an example, the player and/or electronic gaming device 100 may select to have all of the 2D reels and/or 2D paylines activated. In another example, the player and/or electronic gaming device 100 may select to have all of the 3D reels and/or 3D paylines activated. There may be an additional wager required for activating any of the reels and/or paylines.

A player may make an additional wager for the ability to select 3D reels and/or paylines. The ability of the player to select 3D reels and/or paylines may be provided as an award. The ability of players to select 3D reels and/or paylines may be in the base game. The ability of the player to select 3D reels and/or paylines may be part of a bonus game. The ability of the player to select 3D reels and/or paylines may be combined in any structure.

Figure 9C:
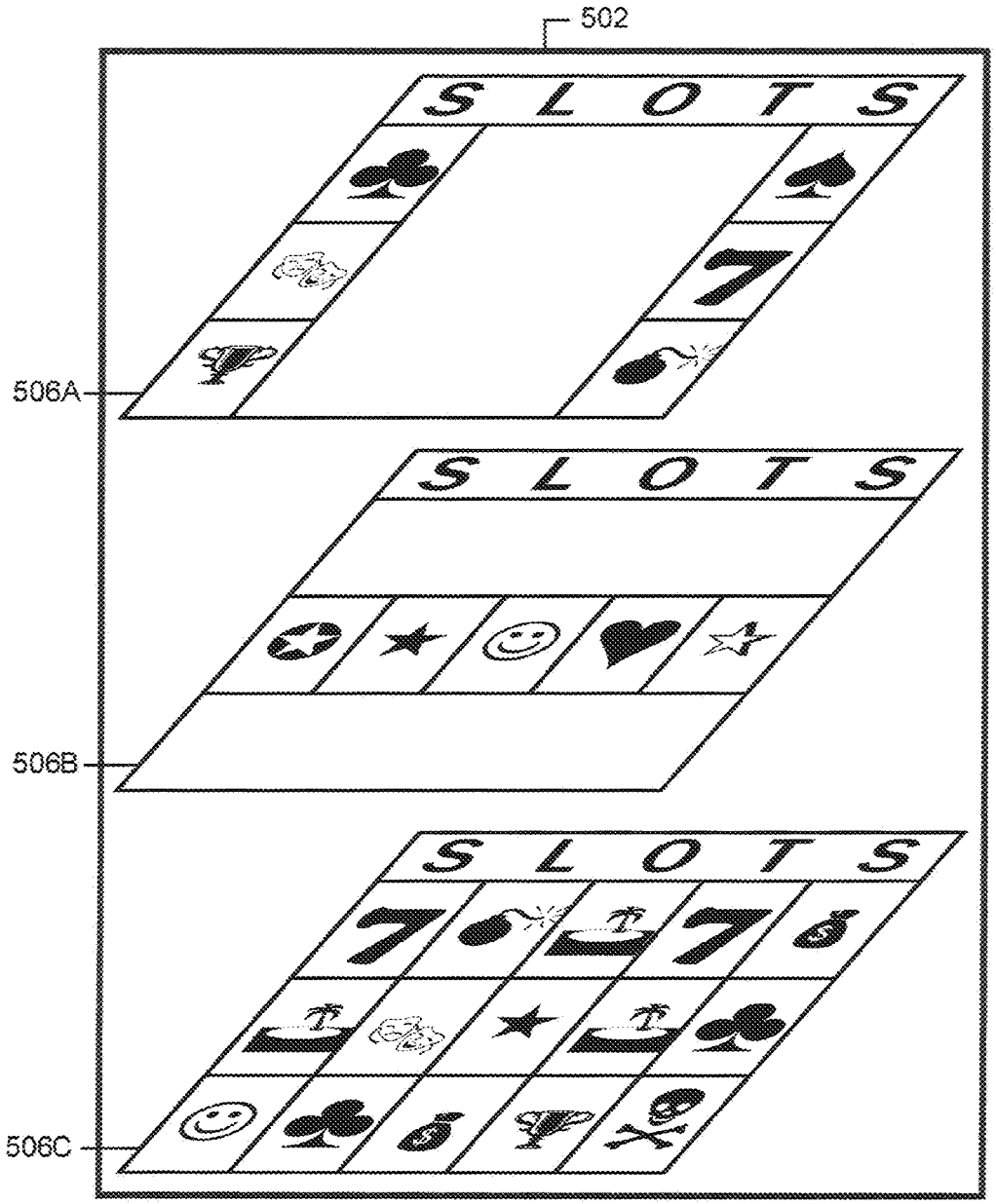
FIG. 9C shows a plurality of slot games (one being a complete slot game and two being partial slot games) vertically arranged and horizontally skewed to create a three-dimensional stacking, according to one embodiment.

FIG. 9C shows a plurality of slot games 506A, 506B, and 506C displayed on display screen 502, according to one embodiment. Slot game 506A is a partial slot game because slot game 506A includes only two of five possible reels. Slot game 506B is a partial slot game because slot game 506B includes only one horizontal slice (or section). Slot game 506C is a complete slot game because slot game 506C includes all five possible reels. Slot games 506A, 506B, and 506C are vertically arranged and horizontally skewed to create a three-dimensional stacking affect, according to one embodiment. The player and/or electronic gaming device 100 may select one or more reels and/or paylines to be activated.

Figure 10:
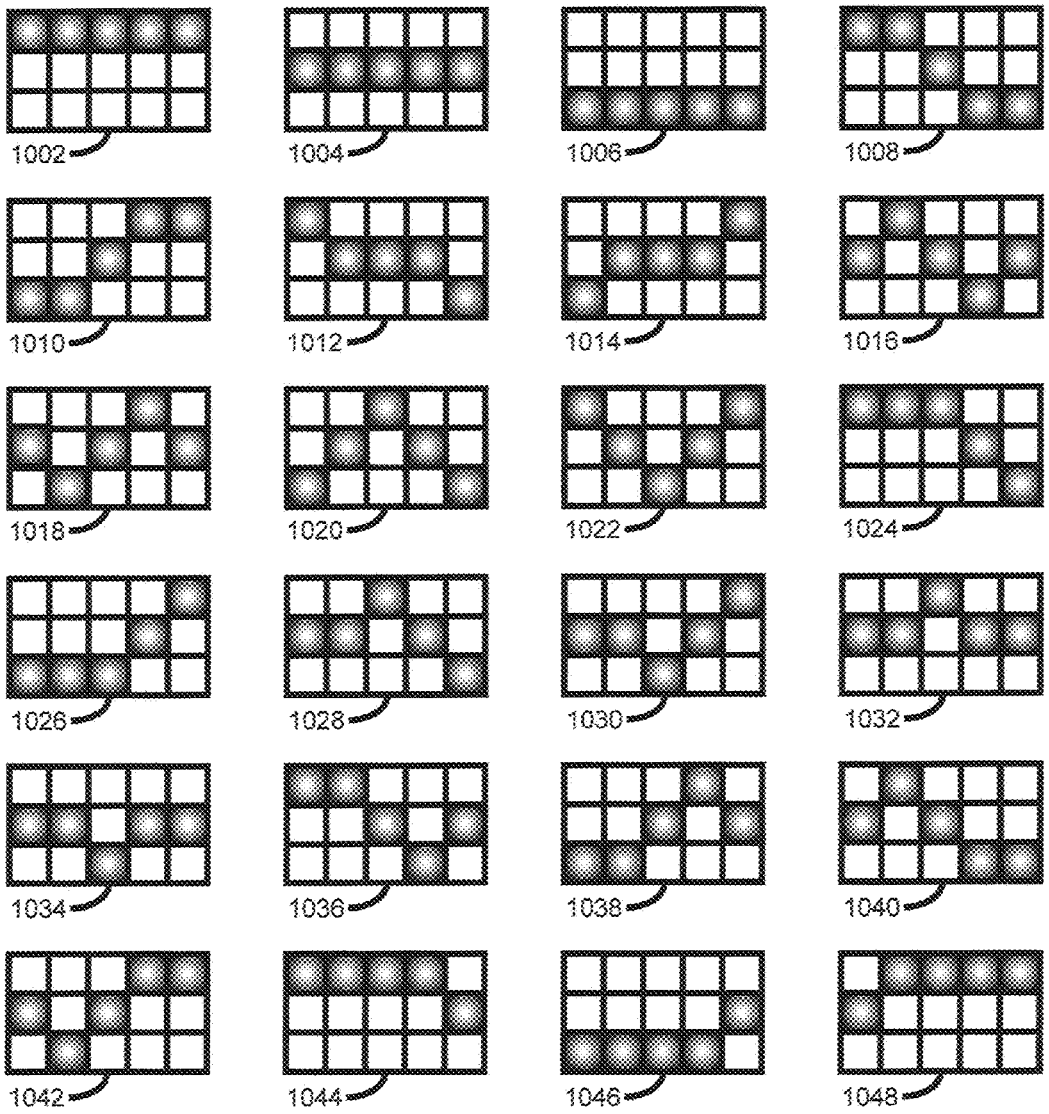
FIG. 10 shows a plurality of possible winning combinations for a five-reel slot game in two-dimensional space, according to one embodiment.

FIG. 10 is an illustration for a plurality of possible two-dimensional winning combinations for a five-reel slot game, according to one embodiment. These two-dimensional winning combinations (e.g., 1002, 1004, 1006, 1008, 1010, 1012, 1014, 1016, 1018, 1020, 1022, 1024, 1026, 1028, 1030, 1032, 1034, 1036, 1038, 1040, 1042, 1044, 1046, and/or 1048) may be utilized with the three-dimensional reels. FIG. 10 is a non-exhaustive list of winning combinations and/or structures.

FIGS. 11A, 11B, 11C, and 11D show illustrations of a plurality of possible winning combinations from a plurality of three-dimensional spaces, according to various embodiments. FIG. 11E shows the axes X, Y, and Z of a three-dimensional coordinate system, according to one embodiment. This three-dimensional coordinate system will be used henceforth for reference.

Figure 11A:
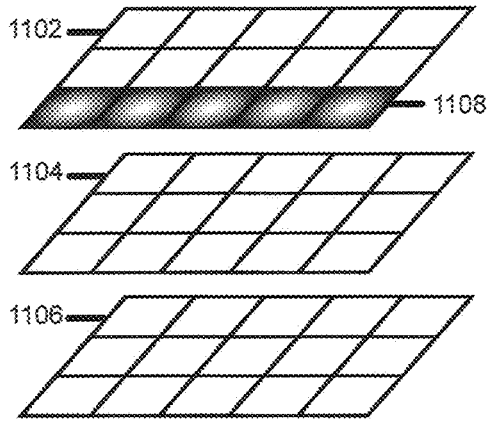
FIGS. 11A, 11B, 11C, and 11D show illustrations of a plurality of possible winning combinations in a three-dimensional space, according to various embodiments.

In FIG. 11A, a one-dimensional (X-Axis) winning combination appears on a first plurality of reels 1102 only as one-dimensional (X-Axis) payline 1108. As shown in FIG. 10, which was a non-exhaustive example, there are numerous winning combinations.

Figure 11B:
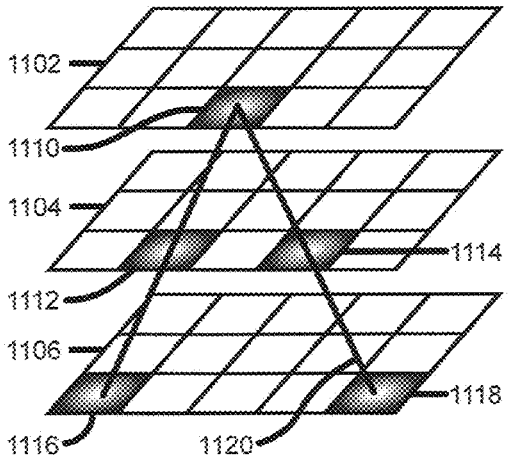
Figure 11E:
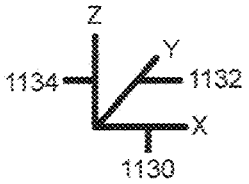
FIG. 11E shows the axes X, Y, and Z of a three-dimensional coordinate system, according to one embodiment.

In FIG. 11B, a two-dimensional (X-Axis and Z-Axis) winning combination appears on first plurality of reels 1102, a second plurality of reels 1104, and a third plurality of reels 1106 as a first two-dimensional (X-Axis and Z-Axis) payline 1120. First two-dimensional payline 1120 includes individual symbols 1116, 1112, 1110, 1114, and 1118 (evaluated left-to-right).

Figure 11C:
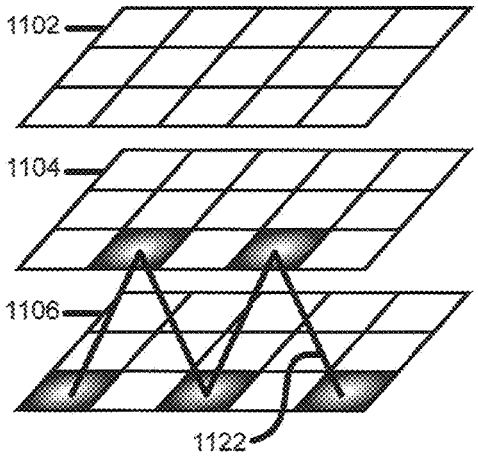

In FIG. 11C, another two-dimensional (X-Axis and Z-Axis) winning combination appears on first plurality of reels 1102 and second plurality of reels 1104 as a second two-dimensional (X-Axis and Z-Axis) payline 1122. Second two-dimensional payline 1122 includes individual symbols 1116, 1112, 1114, and 1118 (evaluated left-to-right).

Figure 11D:
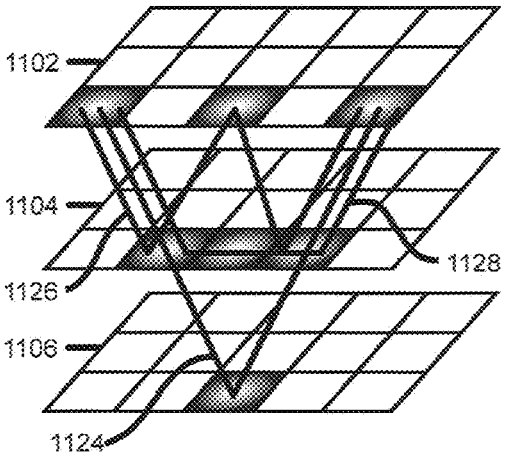

In FIG. 11D, a two-dimensional (X-Axis and Z-Axis) winning combination appears on first plurality of reels 1102, second plurality of reels 1104, and third plurality of reels 1106 as a third two-dimensional (X-Axis and Z-Axis) payline 1124, a fourth two-dimensional (X-Axis and Z-Axis) payline 1126, and a fifth two-dimensional (X-Axis and Z-Axis) payline 1128. It should be noted that any combination of symbols (squares or spaces) on any plane (e.g., x, y, z) may be utilized to generate a winning combination. Further, these two-dimensional paylines may be three-dimensional paylines when any depth/measure is displayed on the Y-Axis.

FIGS. 12A, 12B, 12C, and 12D show illustrations of a plurality of possible winning combinations from a plurality of two-dimensional slot games inter-related in a three-dimensional space, together with representative axes (X, Y, and Z) of the virtual three-dimensional coordinate system, according to various embodiments.

Figure 12A:
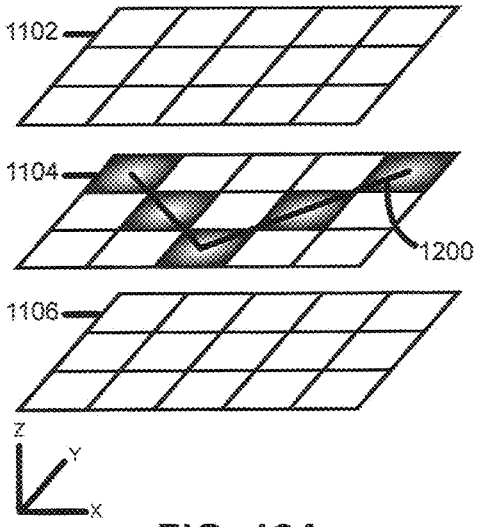
FIGS. 12A, 12B, 12C, and 12D show illustrations of a plurality of possible winning combinations in a three-dimensional space, together with representative axes (X, Y, and Z) of the three-dimensional coordinate system, according to various embodiments.

In FIG. 12A, a two-dimensional (X-Axis and Y-Axis) winning combination appears on second plurality of reels 1104 as a sixth two-dimensional (X-Axis and Y-Axis) payline 1200.

Figure 12B:
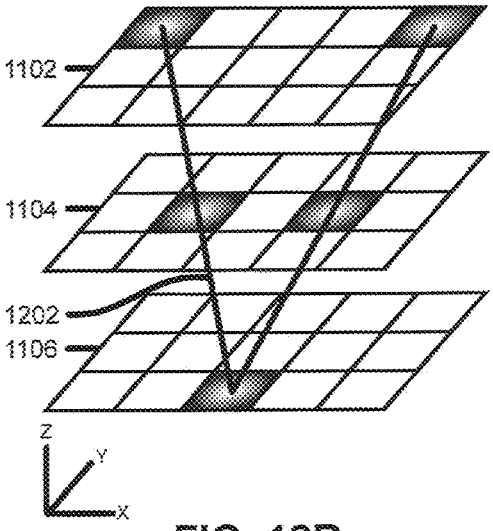

In FIG. 12B, a three-dimensional (X-Axis, Y-Axis, and Z-Axis) winning combination appears on first plurality of reels 1102, second plurality of reels 1104, and third plurality of reels 1106 as a first three-dimensional (X-Axis, Y-Axis, and Z-Axis) payline 1202.

Figure 12C:
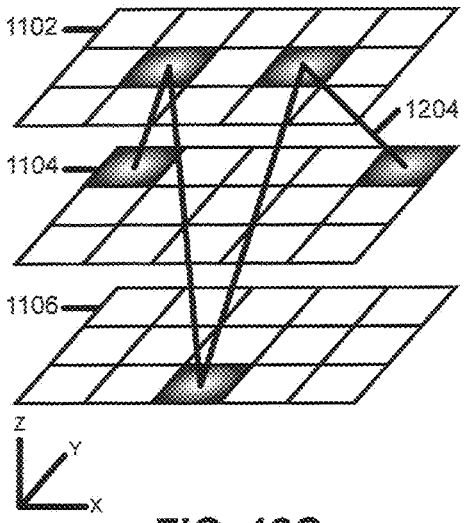

In FIG. 12C, a three-dimensional (X-Axis, Y-Axis, and Z-Axis) winning combination appears on first plurality of reels 1102, second plurality of reels 1104, and third plurality of reels 1106 as a second three-dimensional (X-Axis, Y-Axis, and Z-Axis) payline 1204.

Figure 12D:
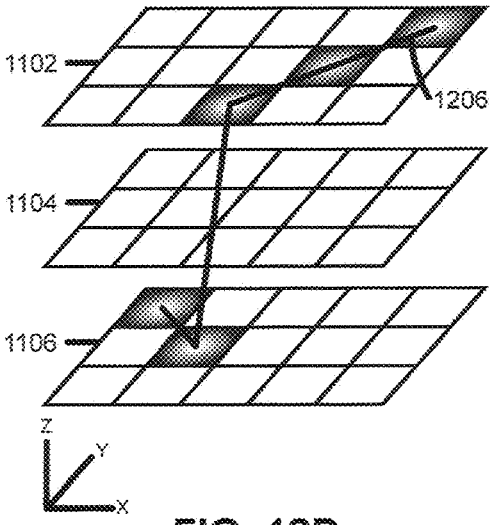

In FIG. 12D, a three-dimensional (X-Axis, Y-Axis, and Z-Axis) winning combination appears on first plurality of reels 1102, second plurality of reels 1104, and third plurality of reels 1106 as a third three-dimensional (X-Axis, Y-Axis, and Z-Axis) payline 1206.

Figure 13A:
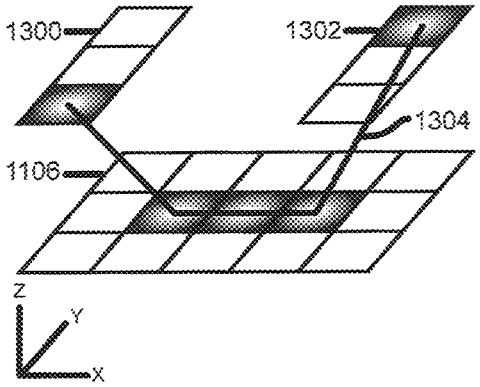
FIGS. 13A, 13B, and 13C show illustrations of a plurality of possible winning combinations in a three-dimensional space, together with representative axes (X, Y, and Z) of the three-dimensional coordinate system, according to various embodiments.
Figure 13B:
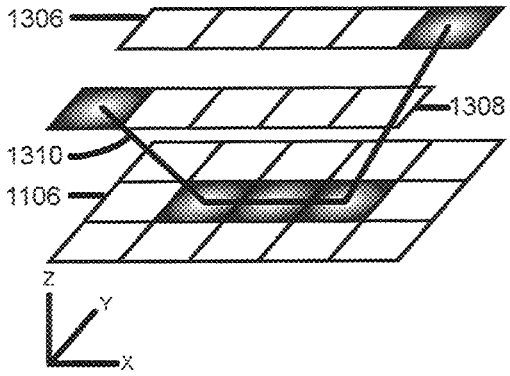
Figure 13C:
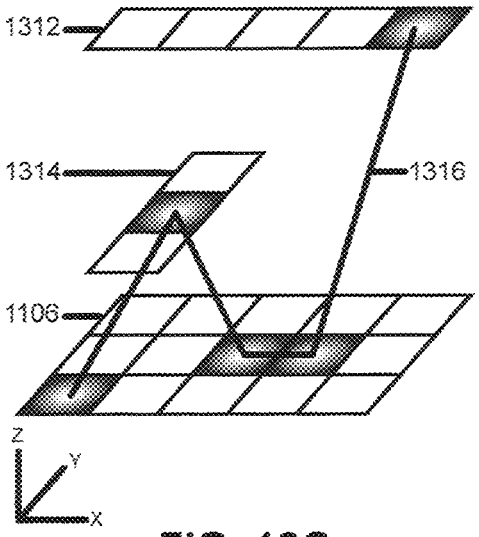

FIGS. 13A, 13B, and 13C show illustrations of a plurality of possible winning combinations, both full and partial, inter-related in a three-dimensional space, together with representative axes (X-Axis, Y-Axis, and Z-Axis) of the three-dimensional coordinate system, according to various embodiments.

In FIG. 13A, a three-dimensional (X-Axis, Y-Axis, and Z-Axis) winning combination appears on second plurality of reels 1104 and third plurality of reels 1106 as a first partial-reel three-dimensional (X-Axis, Y-Axis, and Z-Axis) payline 1304. In this embodiment, the player and/or electronic gaming device 100 selected all of the reels on third plurality of reels 1106, two of the reels on second plurality of reels 1104, and no reels from first plurality of reels 1102. The two reels from second plurality of reels 1104 are represented by reference numbers 1300 and 1302.

In FIG. 13B, a three-dimensional (X-Axis, Y-Axis, and Z-Axis) winning combination appears on first plurality of reels 1102, second plurality of reels 1104, and third plurality of reels 1106 as a second partial-reel three-dimensional (X-Axis, Y-Axis, and Z-Axis) payline 1310. In this embodiment, the player and/or electronic gaming device 100 selected all of the reels on third plurality of reels 1106, one of the reels on second plurality of reels 1104, and one of the reels from first plurality of reels 1102. The one reel from first plurality of reels is represented by reference number 1306. The one reel from second plurality of reels 1104 is represented by reference number 1308.

In FIG. 13C, a three-dimensional (X-Axis, Y-Axis, and Z-Axis) winning combination appears on first plurality of reels 1102, second plurality of reels 1104, and third plurality of reels 1106 as a third partial-reel three-dimensional (X-Axis, Y-Axis, and Z-Axis) payline 1316. In this embodiment, the player and/or electronic gaming device 100 selected all of the reels on third plurality of reels 1106, one of the reels on second plurality of reels 1104, and one of the reels from first plurality of reels 1102. The one reel from first plurality of reels is represented by reference number 1312. The one reel from second plurality of reels 1104 is represented by reference number 1314. The player and/or electronic gaming device 100 may select any number of reels from first plurality of reels 1102, second plurality of reels 1104, and third plurality of reels 1106.

Figure 14:
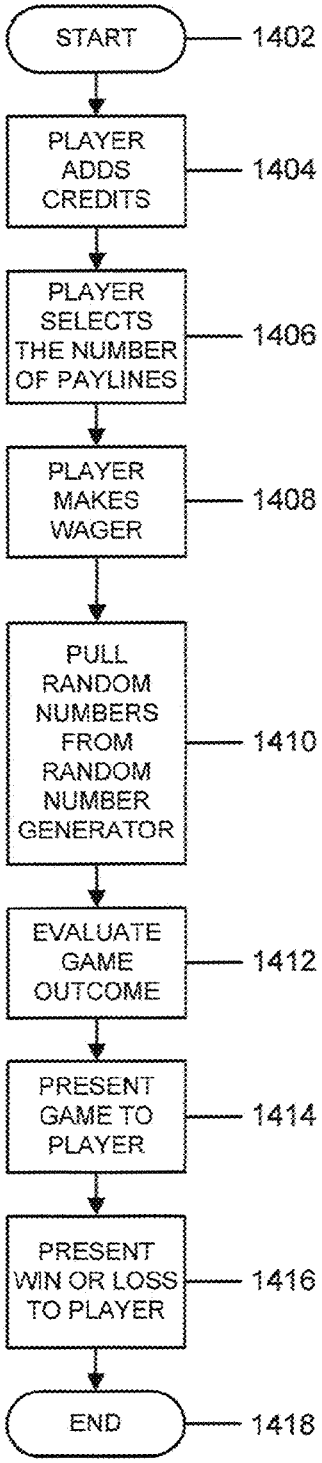
FIG. 14 is a flow diagram for game play, according to one embodiment.

FIG. 14 is a flow diagram for game play, according to one embodiment. The game starts (step 1402). The player may add credits (step 1404). The player may select a number of paylines and/or reels (step 1406). The player may make a wager (step 1408). The processor may pull a random number from the random number generator (step 1410). The processor may evaluate a game outcome (step 1412). In various examples, this evaluation may be based on 2D payout structure, 2D reels, 2D paylines, 3D payout structure, 3D reels, 3D paylines, and/or any combination thereof. The game may be presented (step 1414). The game outcome may be presented (step 1416). The game may end (step 1418).

The player may select the number of paylines via input device 112. The number of paylines may range from one to some maximum. Slot games may have 1, 3, 5, 9, 20, or more paylines in various embodiments. The player may make a wager 1408 via input device 112 and electronic gaming device 100 may pull random numbers from a random number generator.

In one embodiment, all the necessary random numbers are draw prior to animating (spinning) the reels while in another embodiment, one random number is drawn then the individual reel is animated (spun) and stopped; this continues in left-to-right order, until the last reel has stopped animating (spinning).

Electronic gaming device 100 may utilize processor 302 and the pay table stored in memory 304 to evaluate the game outcome. The game may be presented to the player on first display screen 102, and/or the second display screen 104, and/or the third display screen 106, and/or any other display, and/or any combination thereof. This may be followed by presenting the win or loss outcome of the game evaluation on first display screen 102, and/or the second display screen 104, and/or the third display screen 106, and/or any other display, and/or or any combination thereof.

Figure 15:
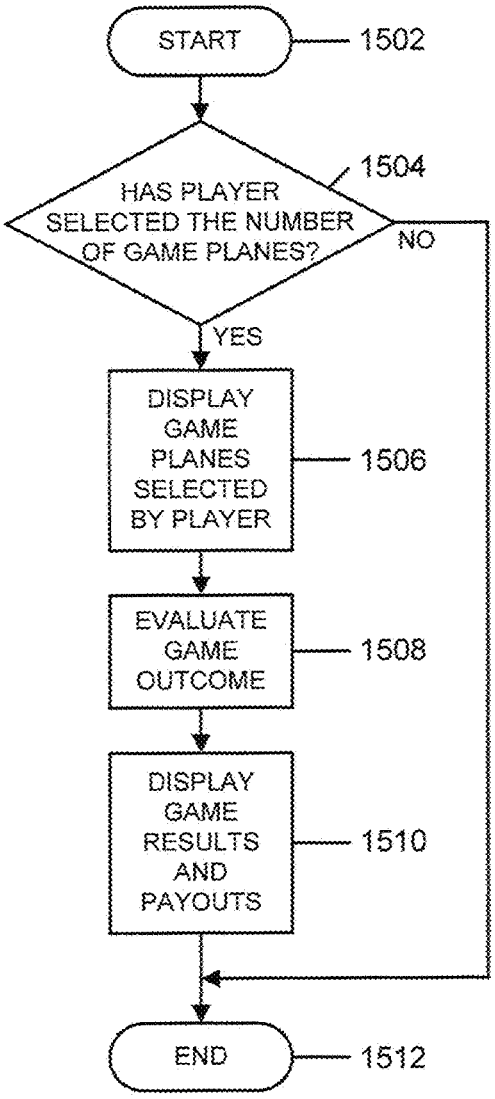
FIG. 15 is a flow diagram for providing three-dimensional gaming options, according to one embodiment.

FIG. 15 is a flow diagram for selecting a number of game planes (e.g., axes, reels, paylines, etc.). The game starts (step 1502). The system and/or method may determine whether a selection of game planes has occurred (step 1504). If no game plane selections have occurred, then the process ends (step 1512). If a game plane has been selected, then the system and/or method may display the game planes selected (step 1506). The system and/or method may evaluate the game outcome (step 1508). In various examples, this evaluation may be based on 2D payout structure, 2D reels, 2D paylines, 3D payout structure, 3D reels, 3D paylines, and/or any combination thereof. The game may display the game results and payouts (step 150). The game may end (step 1512).

The system and/or method may support a plurality of slot games inter-related in a virtual three-dimensional space, according to one embodiment. The system and/or method may display the game planes selected by the player, electronic gaming device 100, and/or electronic gaming system 200 on first display screen 102, and/or second display screen 104, and/or third display screen 106, or any other display, and/or any combination thereof.

Figure 16:
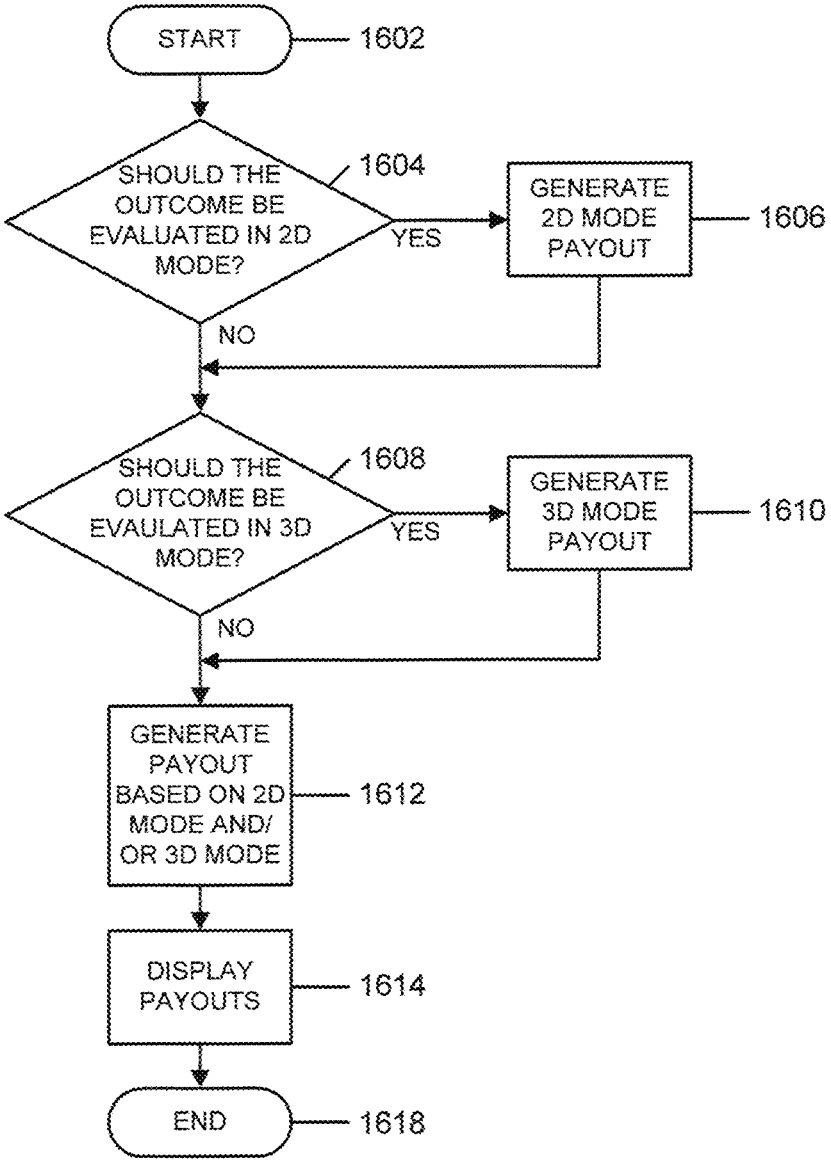
FIG. 16 is a flow diagram for providing two-dimensional gaming options, three-dimensional gaming options, and both, according to one embodiment.

FIG. 16 is a flow diagram for game play, which supports both two-dimensional symbol combinations and/or three-dimensional combinations, according to one embodiment. The game starts (step 1602). The system and/or method may determine whether the outcome should be evaluated in 2D mode (step 1604). If the system and/or method determine that the game play should not be determined in a 2D mode, then the process moves to step 1608. If the system and/or method determine that the game play should be determined in 2D mode, then the system and/or method generates a 2D mode payout (step 1606) and moves to step 1608. The system and/or method may determine whether the game outcome should be evaluated in 3D mode (step 1608). If the system and/or method determine that the game play should not be determined in a 3D mode, then the process moves to step 1612. If the system and/or method determine that the game play should be determined in a 3D mode, then the system and/or method generates a payout based on 2D payouts and 3D payouts (step 1612). The system and/or method may display the game out and payouts (step 1614). The system and/or method may end (step 1618).

Figure 17:
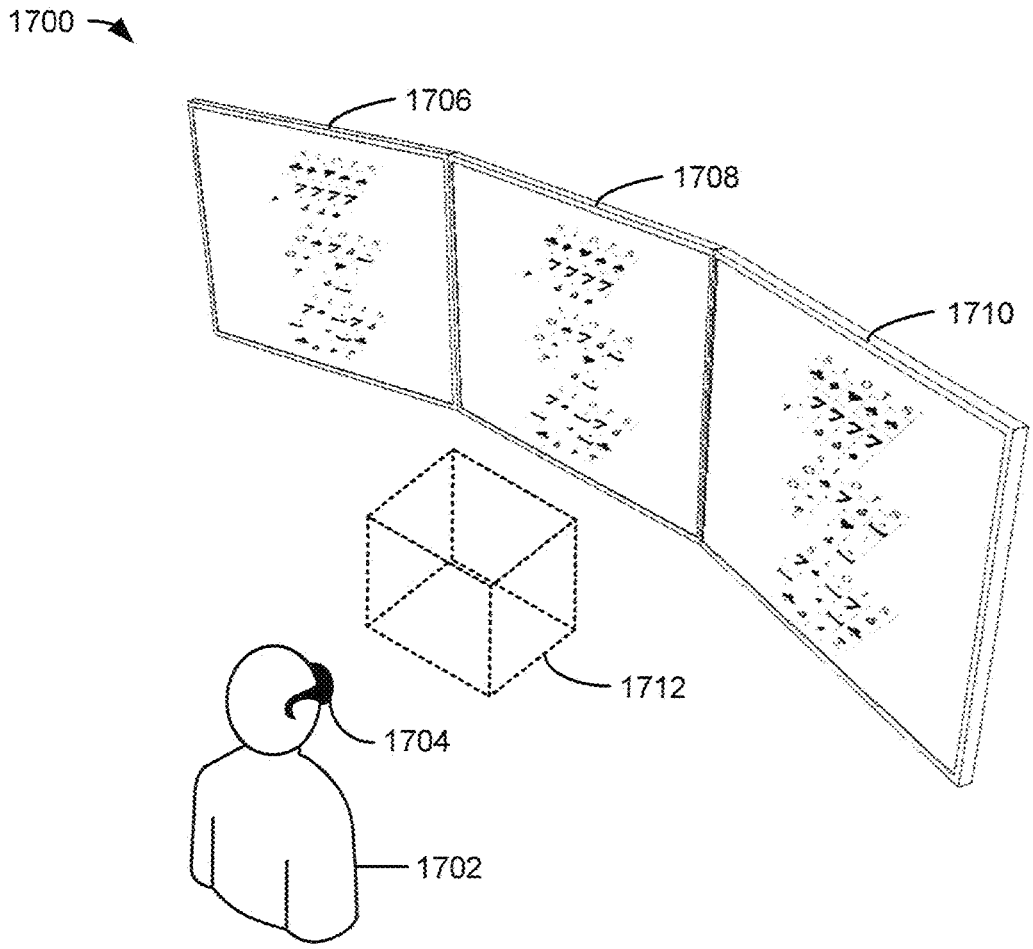
FIG. 17 is an illustration of a three-dimensional projection system, according to an exemplary embodiment.

FIG. 17 shows a three-dimensional projection system 1700, according to an exemplary embodiment. Three-dimensional projection system 1700 may include a first display panel 1706, a second display panel 1708, and a third display panel 1710. First display panel 1706, second display panel 1708, and third display panel 1710 may display one integrated picture, two pictures, three pictures, or any number of pictures and/or images. The pictures and/or images may generate a projected object 1712, which may be viewed with or without requiring a player 1702 to utilize a three-dimensional projection glass 1704. Project object 1712 may be viewed via polarized glass techniques, stacked transmissive displays, open-frame holographic displays, and/or any other three-dimensional projection techniques. First display 1706, second display 1708, third display 1710, and/or any other display may be positioned relative to each other to create a panoramic view, a curved view, and/or to create any other degree view (e.g., 0 to 360 degrees).

These three-dimensional games may have themes, such as, Star Trek™, Star Wars™, etc.

In an example, an electronic gaming device may include a first plurality of reels. The first plurality of reels may include a first set of symbols. The first plurality of reels may be located in a first xyz plane. The electronic gaming device may include a second plurality of reels. The second plurality of reels may include a second set of symbols. The second plurality of reels may be located in a second xyz plane. The electronic gaming device may include a third plurality of reels (up to an $n^{th}$ number of reels). The third plurality of reels may include a third set of symbols (up to an $n^{th}$ number of sets). The first set of symbols, the second set of symbols, the third set of symbols, the nth set of symbols may be the same set of symbols, different set of symbols, and/or any combination thereof. For example, all the set of symbols (e.g., cherries, bars, stars) may be the same. In another example, the first set of symbols may have cherries, bars, and stars, which are not present on any other plurality of reels. In another example, the first set of symbols and the second set of symbols may be the same while the third set of symbols is not the same as first set of symbols and the second set of symbols. In another example, the plurality of reels may have some symbols that are the same while other symbols are different. For example, the wild symbols are the same for all of the plurality of reels while the other symbols are not the same on the plurality of reels.

In another example, the electronic gaming device may include a memory. The memory may include a three-dimensional payline module. The three-dimensional payline module may include a plurality of three-dimensional payline structures. The electronic gaming device may include a processor, which may determine a three-dimensional payout based on one or more three-dimensional payline structures.

In another embodiment, the memory may include a non-three-dimensional payline module. The non-three-dimensional payline module may include a plurality of non-three-dimensional payline structures.

In an example, the processor may determine a payout based on one or more non-three-dimensional payline structures. The processor may determine a three-dimensional payout based on one or more three-dimensional payline structures utilizing the third plurality of reels. The processor may determine a payout based on one or more non-three-dimensional payline structures utilizing the third plurality of reels.

In an embodiment, the processor may activate at least one reel from at least one of the first plurality of reels, the second plurality of reels, the third plurality of reels, and the $n^{th}$ plurality of reels. An activation of one reel from at least one of the first plurality of reels, the second plurality of reels, the third plurality of reels, and the $n^{th}$ plurality of reels may be based on input received from a player, the electronic gaming device, and/or the electronic gaming system.

In another example, the processor may determine a three-dimensional payout based on an activation of one reel from at least one of the first plurality of reels, the second plurality of reels, the third plurality of reels, and the $n^{th}$ plurality of reels.

In another embodiment, a method of providing gaming play may include displaying a first plurality of reels in a first xyz plane. The method may include displaying a second plurality of reels in a second xyz plane. The method may include displaying a third plurality of reels in a third xyz plane. The method may include displaying an $n^{th}$ plurality of reels in any one of the planes. The method may include determining a three-dimensional payout based on data from the first plurality of reels, the second plurality of reels, the third plurality of reels, and the $n^{th}$ plurality of reels.

In another example, the method may include determining a non-three-dimensional payout based on data from the first plurality of reels, the second plurality of reels, the third plurality of reels, and the $n^{th}$ plurality of reels.

In an example, the method may include activating at least one reel from at least one of the first plurality of reels, the second plurality of reels, the third plurality of reels, and the $n^{th}$ plurality of reels. The method may also include determining a three-dimensional payout based on an activation of one reel from at least one of the first plurality of reels, the second plurality of reels, the third plurality of reels, and the $n^{th}$ plurality of reels.

In another embodiment, an electronic gaming system may include a server. The server may include a server memory and a server processor. The server processor may display a first plurality of reels, a second plurality of reels, a third plurality of reels, and an $n^{th}$ plurality of reels in a first plane (e.g., a first xyz plane), a second plane (e.g., a second xyz plane), and/or a third plane (e.g., a third xyz plane).

In another example, the server memory may include a three-dimensional payline module. The three-dimensional payline module may include a plurality of three-dimensional payline structures. The server processor may determine a three-dimensional payout based on one or more three-dimensional payline structures.

In an example, the server memory may include a non-three-dimensional payline module. The non-three-dimensional payline module may include a plurality of non-three-dimensional payline structures.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

a credit device configured to accept a physical item associated with a monetary value;

a user input device configured to enable a player to select a wager amount and initiate a game play where the wager amount is subtracted from a credit balance, the credit balance being funded at least in part via the credit device;

a processor configured to initiate a non-three dimensional game play mode and a three dimensional game play mode, the processor configured to utilize a plurality of display areas in the non-three dimensional game play mode and to interact with a memory to generate a non-three dimensional payout during the non-three dimensional game play mode, the memory includes a non-three-dimensional payline module, the non-three-dimensional payline module includes a plurality of non-three-dimensional payline structures;

the processor configured to utilize a first plurality of reels, the first plurality of reels including a first set of symbols, the first plurality of reels being located in a first xyz plane in the three dimensional game play mode;

the processor configured to utilize a second plurality of reels, the second plurality of reels including a second set of symbols, the second plurality of reels being located in a second xyz plane in the three dimensional game play mode;

the memory including a three-dimensional payline module, the three-dimensional payline module including a plurality of three-dimensional payline structures; and the processor configured to determine a three-dimensional payout based on one or more three-dimensional payline structures;

wherein any determined award is added to the credit balance;

wherein the second plurality of reels have at least one less reel than the first plurality of reels.

2. The electronic gaming device of claim 1, wherein the processor is further configured to determine a 2D payout during the three dimensional game play mode.

3. The electronic gaming device of claim 1, further comprising a third plurality of reels, the third plurality of reels including a third set of symbols, the third plurality of reels being located in a third xyz plane in the three dimensional game play mode.

4. The electronic gaming device of claim 3, wherein the processor is further configured to determine the three-dimensional payout based on one or more three-dimensional payline structures utilizing the third plurality of reels.

5. The electronic gaming device of claim 4, wherein the processor is further configured to determine a 2D payout during the three dimensional game play mode.

6. The electronic gaming device of claim 3, wherein the first set of symbols, the second set of symbols, and the third set of symbols are the same set of symbols.

7. The electronic gaming device of claim 1, wherein the processor is further configured to activate at least one reel from at least one of the first plurality of reels and the second plurality of reels.

8. The electronic gaming device of claim 7, wherein an activation of one reel from at least one of the first plurality of reels and the second plurality of reels is based on input received from the player.

9. The electronic gaming device of claim 7, wherein the processor is further configured to determine the three-dimensional payout based on an activation of one reel from at least one of the first plurality of reels and the second plurality of reels is based on input received from the player.

10. A method of providing gaming play comprising:

receiving via a credit device a physical item associated with a monetary value;

establishing via one or more processors a credit balance based at least in part on the received item;

receiving via a wager button a wager amount on a play of a game, wherein the wager amount is deducted from the credit balance;

initiating via the one or more processors at least one of a non-three dimensional game play mode and a three dimensional game play mode;

during the non-three dimensional game play mode, utilizing via the one or more processors a plurality of display areas to generate a non-three dimensional payout;

during the three dimensional game play mode, displaying via the one or more processors a first plurality of reels in a first xyz plane;

displaying via the one or more processors a second plurality of reels in a second xyz plane; and determining via the one or more processors a three-dimensional payout based on data from the first plurality of reels and the second plurality of reels;

wherein the second plurality of reels have at least one less reel than the first plurality of reels;

wherein any determined award is added to the credit balance.

11. The method of claim 10, further comprising activating at least one reel from at least one of the first plurality of reels and the second plurality of reels.

12. The method of claim 11, further comprising determining the three-dimensional payout based on an activation of one reel from at least one of the first plurality of reels and the second plurality of reels.

13. The method of claim 10, further comprising displaying a third plurality of reels in a third xyz plane.

14. The method of claim 13, further comprising:

determining the three-dimensional payout based on data from the third plurality of reels.

15. An electronic gaming system comprising:

a credit device configured to accept a physical item associated with a monetary value;

a user input device configured to enable a player to select a wager amount and initiate a game play, wherein the wager amount is subtracted from a credit balance funded at least in part via the credit device;

a server including a server memory and a server processor;

the server processor configured to initiate a non-three dimensional game play mode and a three dimensional game play mode, the processor configured to utilize a plurality of display areas in the non-three dimensional game play mode and to interact with the server memory to generate a non-three dimensional payout during the non-three dimensional game play mode, the server memory includes a non-three-dimensional payline module, the non-three-dimensional payline module includes a plurality of non-three-dimensional payline structures;

the server processor configured to display a first plurality of reels in a three dimensional game play mode, the first plurality of reels being located in a first xyz plane, a second plurality of reels, the second plurality of reels being located in a second xyz plane;

the server processor configured to interact with the server memory including a three-dimensional payline module, the three-dimensional payline module including a plurality of three-dimensional payline structures, to generate a three-dimensional payout based on one or more three-dimensional payline structures;

wherein the second plurality of reels have at least one less reel than the first plurality of reels;

wherein any determined award is added to the credit balance.

16. The electronic gaming system of claim 15, wherein the server processor is further configured to determine a 2D payout during the three dimensional game play mode.

17. The electronic gaming system of claim 15, wherein the server processor is further configured to display a third plurality of reels, the third plurality of reels being located in a third xyz plane.

* * * * *